United States Patent [19]

Hayashi et al.

[11] 4,108,296

[45] Aug. 22, 1978

[54] COIN RECEIVING APPARATUS FOR A VENDING MACHINE

[75] Inventors: Yukichi Hayashi; Masayuki Tamura; Osamu Sugimoto, all of Sakado; Masayoshi Takizawa, Kitamoto; Tatsujiro Nishioka, Yokohama, all of Japan

[73] Assignee: Nippon Coinco Co., Ltd., Japan

[21] Appl. No.: 780,153

[22] Filed: Mar. 22, 1977

[30] Foreign Application Priority Data

| | | | |
|---|---|---|---|
| Apr. 8, 1976 | [JP] | Japan | 51-39580 |
| Apr. 23, 1976 | [JP] | Japan | 51-46262 |
| May 14, 1976 | [JP] | Japan | 51-61095[U] |

[51] Int. Cl.[2] ..... G07F 3/02

[52] U.S. Cl. ..... 194/99; 194/100 A

[58] Field of Search ..... 194/97 R, 99, 100 R, 194/100 A, 101, 102; 73/163; 209/81 R, 81 A

[56] References Cited

U.S. PATENT DOCUMENTS

| | | | |
|---|---|---|---|
| 3,869,663 | 3/1975 | Tschierse | 194/100 A X |
| 3,901,368 | 8/1975 | Klinger | 194/100 A |
| 3,933,232 | 1/1976 | Searle et al. | 194/100 A |

FOREIGN PATENT DOCUMENTS

| | | | |
|---|---|---|---|
| 2,315,963 | 10/1974 | Fed. Rep. of Germany | 73/163 |
| 2,053,704 | 5/1972 | Fed. Rep. of Germany | 194/100 A |
| 407,617 | 8/1966 | Switzerland | 194/100 A |

*Primary Examiner*—Joseph J. Rolla

*Attorney, Agent, or Firm*—Ladas, Parry, Von Gehr, Goldsmith & Deschamps

[57] ABSTRACT

A coin receiving apparatus for a vending machine capable of accurately checking a coin diameter as well as other coin characteristics such as material and a surface pattern for discriminating a true coin from a false one and receiving the former and rejecting the latter. The diameter and other coin characteristics are detected by examining peak values of output waveshapes of coin detectors by means of a window circuit. A single window circuit is provided for each denomination and upper and lower limit values of the window circuit are automatically changed in accordance with a coin characteristic under examination. Frequencies of excitation signals of the various coin detectors are also automatically changed. If a plurality of coins are successively inserted in the coin receiving apparatus without a sufficient time interval, discrimination of the inserted coins is inhibited and the inserted coins are returned.

5 Claims, 14 Drawing Figures

COIN RECEIVING APPARATUS FOR A VENDING MACHINE

BACKGROUND OF THE INVENTION

This invention relates to a vending machine and, more particularly, to a coin receiving apparatus for a vending machine.

The coin receiving apparatus for a vending machine must serve to detect whether inserted coins are true or false and to then accurately receive only true coins. There has already been proposed a differential transformer type electronic coin detector for detecting inserted coins in the machine, but this differential transformer type coin detector sometimes erroneously receives a false coin having a slightly larger diameter than a true coin and being made of lead. Accordingly, it has been desired to provide a coin receiving apparatus which can accurately judge or detect the diameter of the inserted coin in addition of other characteristics of the inserted coin such as its material, surface incuse pattern and shape, as functions for detecting the inserted coins in high accuracy. Heretofore, examination of diameter of the inserted coins has been conducted by means of a simple mechanical classifying mechanism, but such mechanical device for detecting the inserted coin diameter requires a complicated and large coin receiving apparatus and also are highly susceptible to troubles.

SUMMARY OF THE INVENTION

It is, therefore, an object of the invention to provide a coin receiving apparatus for a vending machine which can accurately judge or detect diameter of an inserted coin in addition to material of the coin, etc.

In the coin receiving apparatus of this invention a coin diameter detector is composed of an electronic detector employing one or more transformers, which detector is so arranged in a coin detection path that the magnetic field of the transformer crosses at right angles with the diameter of the coin. According to such arrangement of the coin detector, the detector produces a coin detection waveshape having a peak value corresponding to the diameter of the inserted coin.

The coin receiving apparatus of this invention also comprises, in addition to the above described transformer type coin diameter detector, one or more coin detectors employing a differential transformer and all of these detectors are sequentially arranged in the coin detection passage for detecting characteristics of the inserted coin such as material, surface incuse pattern and shape in addition to the coin diameter so as to successively detect various characteristics of the inserted coin upon passage of the coin in such a manner that if all of the characteristics of the inserted coin coincide with those conditions of a true coin, the inserted coin is judged as a true coin and then is received as such. Therefore, according to the coin receiving apparatus of this invention, accuracy in coin detection is remarkably improved.

In order to judge a peak value of the coin detection waveform from the respective coin detectors, the coin receiving apparatus of this invention comprises a window circuit which is constructed to detect whether the peak value comes between the upper limit reference value and the lower limit reference value, both of which values are preset therein. The peak values of the waveshapes of a true coin thus detected are different from each other depending upon the characteristics of the inserted coin such as diameter, material, and surface incuse pattern and shape thereof with respect to a coin of each denomination.

Therefore, the upper and lower limit reference values in the window circuit must assume different values depending upon the characteristics of a coin of each denomination. If, accordingly, the reference values in the window circuit are unchangeable, the coin receiving apparatus must have a number of window circuits corresponding to the respective coin characteristics with respect to each denomination.

Accordingly, the coin receiving apparatus of this invention employs a sole window circuit for a coin of each denomination, which circuit has a set of different upper and lower limit reference values which are automatically switched from one to another in accordance with each characteristic of the coin to be detected by the respective detectors.

As previously described, the coin detectors corresponding to the characteristics of the respective coins are sequentially arranged in a predetermined order along the coin detection path. In case an inserted coin to be detected passes either one of the coin detectors, a primary winding coil of the detector is energized and thereby is brought into a state in which it can detect the inserted coin. The respective primary coils of the sequentially arranged coin detectors are energized in turn as the inserted coin passes through these detectors. Therefore, the excited state of the primary coil of the coin detector corresponds to detection of the inserted coin.

Thus, the coin receiving apparatus of this invention is so constructed that the reference limit values in the window circuit thereof are switched to predetermined values upon excitation of the primary coils of the respective coin detectors. Therefore, the coin receiving apparatus of this invention is greatly simplified in the circuit arrangements.

Further, the coin receiving apparatus of this invention is also characterized by that the information from the coin detectors which are presently detecting the inserted coin is stored in a sequential memory circuit such as a shift register in response to the coin detection output from the coin detector and the primary coils of the respective coin detectors are successively excited in response to the contents of the stored information.

Since the respective coin detectors are successively arranged along the coin detection path of the coin receiving apparatus, the judgement as to whether the inserted coin is true or not is made only after detection of the inserted coin by the last coin detector. The information of the inserted coin detected by the coin detectors of preceding stages is stored in memories composed of suitable memory devices such as flip-flops. When the detected result of the coin detector of the final stage has been produced, the inserted coin is received by the coin receiving apparatus only if all the detected results of the inserted coin including those obtained by the coin detectors of the preceding stages indicate that the inserted coin is true.

Therefore, if two or more coins are inserted successively without a proper interval, i.e., in a case where a subsequently inserted coin is detected by any of the coin detectors in the coin detection path while a coin previously inserted in the apparatus and still passing through the coin detection path is being detected by any of the other coin detectors, an accurate judgement as to whether the inserted coin is true or not cannot be made.

Therefore, the coin receiving apparatus of this invention is so constructed that it will be reset and return a subsequently inserted coin if two or more coins are successively inserted in the apparatus without a sufficient interval as described above. Further, the apparatus comprises a timer which produces an output having an operation time corresponding to the time duration required for the passage of the inserted coin through the entire length of the coin detection path from the initial coin detector to the last coin detector and discharges the apparatus from the reset state by this output when the operation time has passed.

The operation time of the timer starts when the inserted coin reaches the coin detector of the first stage in the coin detection path. If a subsequently inserted coin has entered the detector of the first stage during operation time with respect to a previously inserted coin, the operation time with respect to the previously inserted coin is cancelled and a new operation time starts. Accordingly, in case two or more coins are inserted in the coin receiving apparatus without a sufficient interval, the aforementioned reset state is cancelled when the operation time of the timer has elapsed from time when the last coin has entered the detector of the first stage.

Thus, the reset state of the apparatus is retained until the last coin of the successively inserted coins has passed through the coin detection path and has been introduced to the coin return path, whereby rejection of coins inserted in too rapid succession is ensured. It will be appreciated that when two or more coins are successively inserted in the coin receiving apparatus with an interval longer than the operation time of the timer, the coin receiving apparatus of this invention operates in an ordinary manner.

When two or more coins are continuously inserted in the coin receiving apparatus in an ordinary manner (i.e. with a sufficient time interval, if these coins are all judged to be correct in the coin detection path, a receiving solenoid is energized, and the true coin thus inserted is received in a true coin receiving path of the vending machine. The receiving solenoid in the prior art vending machine is energized each time a true coin is inserted in the coin receiving apparatus. However, since such prior art machine frequently repeats energization and deenergization of the receiving solenoid upon continuous insertion of true coins, the life of the machine is thereby adversely affected. In addition, discrepancy tends to occur between the timing of the energization of the solenoid and the timing of the coin passage.

The coin receiving apparatus of this invention is advantageously constructed in that a timer is provided to have a suitable operation time so that it is set when a coin is inserted in the apparatus to keep the receiving solenoid energized during the operation time of the timer. If a subsequently inserted coin is judged to be true during this operation time of the timer, i.e., true coins are successively inserted in the machine, the timer is set again so as to substantially delay the operation time of the time and thereby cause the receiving solenoid to be continuously energized. Accordingly, in case coins successively inserted with a sufficient time interval are all judged to be true, the receiving solenoid is continuously energized, so that the coin receiving path is kept opened, enabling successively inserted coins to be received. As a result, frequent opening and closing of the coin receiving path do not occur and fatigue of the component parts can be prevented.

BRIEF DESCRIPTION OF THE DRAWINGS

FIG. 8(*b*) is a plan view of the outer diameter detector shown in FIG. 8(*a*);

FIG. 11(*b*) is a plan view of the outer diameter detector shown in FIG. 11(*a*); and, FIG. 12 is a view showing electrical connections of a differential transformer employed in still another outer diameter detector.

DESCRIPTION OF THE PREFERRED EMBODIMENTS

Figure 1:
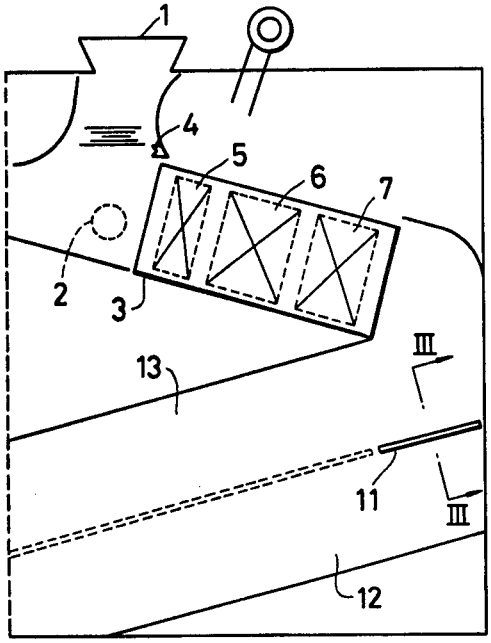
FIG. 1 is a view schematically showing a mechanical construction of an embodiment of the coin receiving apparatus according to the invention.

Referring first to FIG. 1, a coin inserted from an insertion slot 1 is introduced to a coin detection path 3 is so constructed that projection of the screw 2 can be adjusted at one end in the coin path for controlling the thickness of the coin to be inserted in the coin detection path 3 so as to stop a false coin which is thicker than the true coin by means of the screw 2.

There is provided a thread cutting edge 4 projecting at a sharp end thereof in the coin path of the coin detection path 3, which edge 4 is provided to prevent articles from being stolen by suspending a thread which has a coin connected to the end thereof in the coin path from the slot 1.

Figure 2:
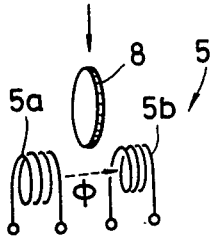
FIG. 2 is a view showing an example of a coin diameter detector.
Figure 4:
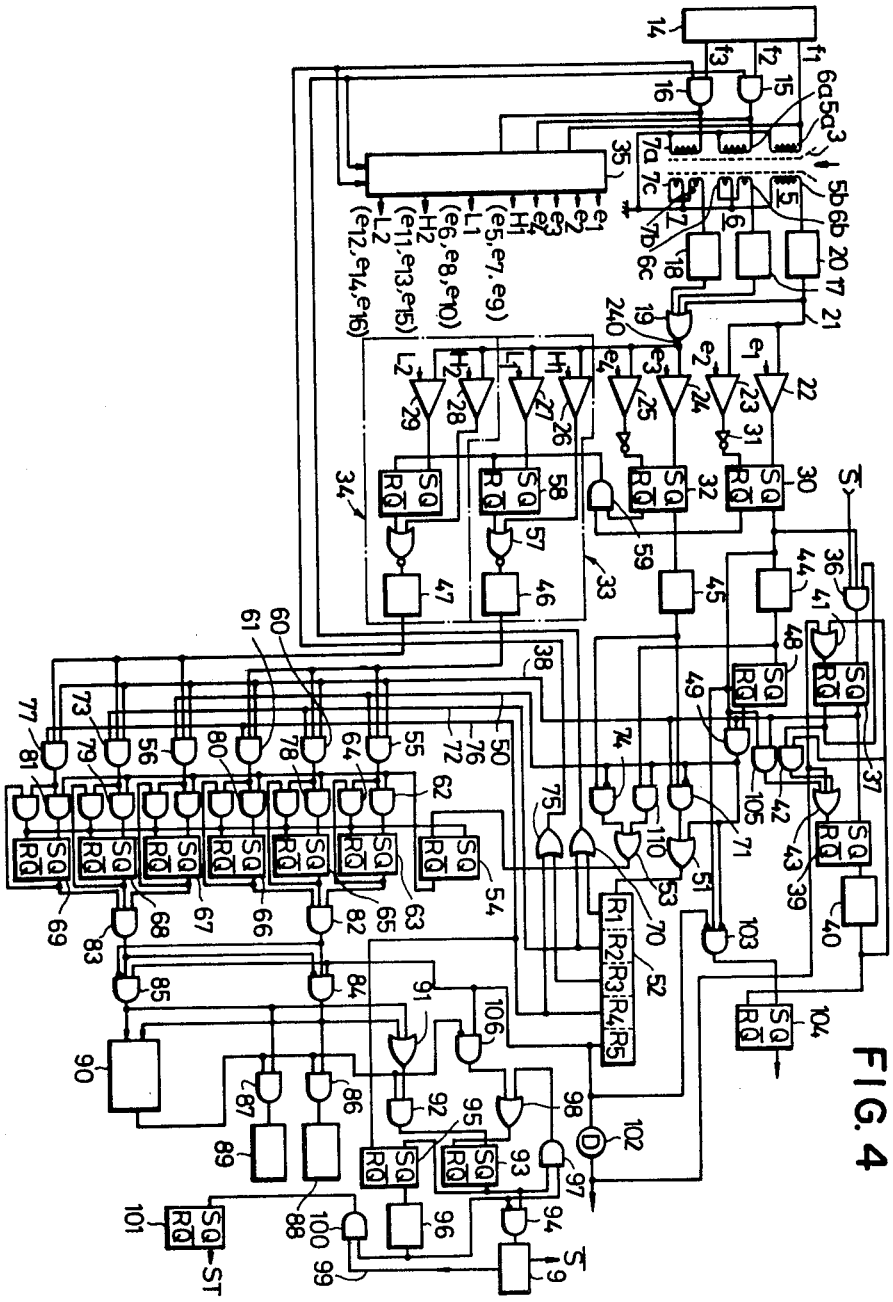
FIG. 4 is a block diagram showing a circuit portion of the embodiment of the coin receiving apparatus shown in FIG. 1.

Three coin detectors 5, 6 and 7 are sequentially arranged in the coin detection path 3. The coin detector 5 of the initial stage is constructed to detect the diameter of the inserted coin and has a primary winding coil 5*a* and a secondary winding coil 5*b*, as shown in FIGS. 2, and 4. In FIG. 2. these winding coils 5*a* and 5*b* are so arranged that magnetic flux $\phi$ substantially perpendicularly crosses the diameter of the coin 8 falling in the coin detection path 3. Accordingly, the larger the diameter of the coin is, the more is the magnetic flux $\phi$ crossed by the coin. Thus, the coin detector 5 produces a detected waveshape having a peak value (negative peak value in this case) corresponding to the diameter of the coin from the secondary winding coil 5*b*.

The coin detectors 6 and 7 of the following stages employ a coin detector of differential transformer type and are constructed to detect respectively different characteristics of the coin inserted in the apparatus. For example, the coin detector 6 is constructed to detect the material of the inserted coin, while the other coin detector 7 is constructed to detect the surface incuse pattern and shape of the inserted coin. For this purpose, an excitation frequency $f_2$ of the primary winding coil 6*a* of the coin detector 6 (see FIG. 4) should preferably be a frequency which is suitable for detecting the material of the inserted coin, while an excitation frequency $f_3$ of the primary winding coil 7*a* of the detector 7 (see FIG. 4) should preferably be a frequency convenient for detecting the surface incuse pattern and shape of the inserted coin.

Figure 3:
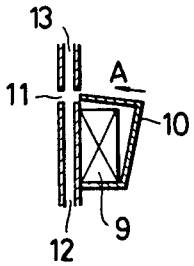
FIG. 3 is a sectional view taken along line III — III in FIG. 1.

When the inserted coin has passed through the coin detector 7 of the final stage, the detection as to whether the inserted coin 8 is true or false is completed. If the inserted coin has been judged true, the receiving solenoid 9 (see FIG. 3) is energized, and a coin receiving projection 10 is pulled in the coin detection path as designated by an arrow A (see FIG. 3). An opening 11 formed in the lower portion of the end of the path 3 is normally opened toward a return path 12 and is closed by the projection 10 when the solenoid 9 is energized by the detection of the true coin. Therefore, the inserted coin 8 delivered from the coin detection path 3 is introduced into a true coin path 13 only when the solenoid 9 is energized. Otherwise, the inserted coin 8 is introduced into the return path 12 located at the lower side of the path 13 via the opening 11 and then to a return port (not shown).

A circuit arrangement shown in FIG. 4 is constructed to control the inserted coin receiving operation in the mechanism shown in FIG. 1 and also to supply a counting pulse to a counter for counting the amount of the inserted coin upon recipt of the inserted coin.

An oscillator 14 supplies predetermined excitation frequencies $f_1$ to $f_3$ to the primary winding coils 5*a* to 7*a* of the respective coin detectors 5 to 7 in such a manner that the frequency $f_1$ is always applied to the coin diameter detector 5 and the other frequencies $f_2$ and $f_3$ are applied to the coin detectors 6 and 7, respectively via AND gates 15 and 15.

Coin detection signals outputted from the two secondary winding coils 6*b*, 6*c* and 7*b*, 7*c* of the coin detectors 6 and 7, respectively of differential transformer type connected in opposite series to each other are applied to rectification amplifiers 17 and 18, respectively to have their alternating current components removed and then applied to an OR gate 19. In the meanwhile, the detection signal produced from the secondary coil 5*b* of the coin detector 5 is applied to a rectification and phase inversion amplifier 20 to have its alternating current component removed and to have it negative peak waveshape inverted to a positive peak waveshape. In this embodiment, since the inserted coin detection waveform of the detector 5 is of a V-shaped attenuated waveshape, this waveform is inverted to an inverted V-shape.

Figure 5:
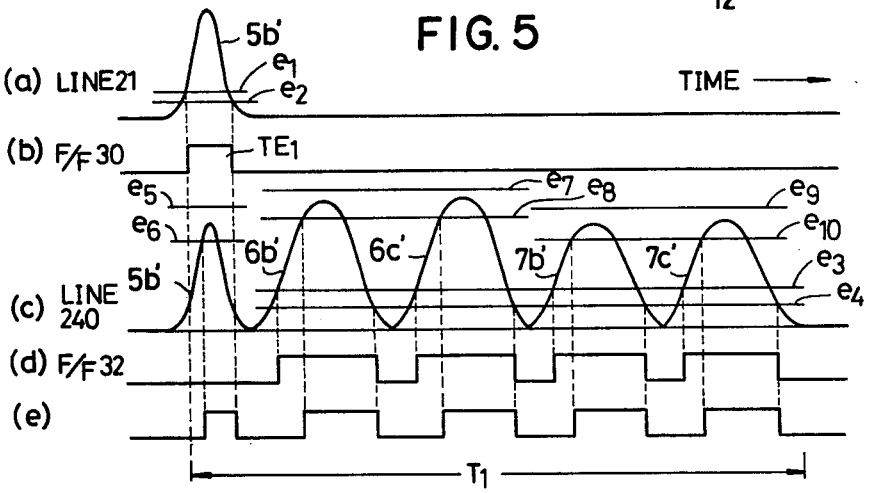
FIG. 5 is a timing chart showing waveforms of outputs from respective portions of the circuit portion shown in FIG. 4.

The detection signal from the detector 5 is applied to comparators 22 and 23 via a line 21 and is also supplied on a line 240 via an OR gate 19. Therefore, the detection signals are successively produced on the secondary coils 5*b*; 6*b*, 6*c* and 7*b*, 7*c* of the respective coin detectors 5, 6 and 7, respectively in response to one coin passing through the coin detection path 3. Thus, the inserted coin detection waveshape 5*b*′ of the detector 5 appears on the line 21 as shown in FIG. 5(*a*). On the line 240 appears sequentially the coin diameter detection waveshape 5*b*′, coin material detection waveshapes 6*b*′, 6*c*′ and coin surface incuse pattern and shape detection waveshapes 7*b*′, 7*c*′ as shown in FIG. 5(*c*). The detection waveshapes on the line 240 are applied to the inputs of the comparators 24 to 29 and are respectively compared with reference levels set in the respective comparators 24 to 29.

The comparators 22 and 23 are provided to detect the insertion of the coin to the coin diameter detector 5, and the lower level in the vicinity of bottom of the coin diameter detection waveshape 5*b*′ is defined as a set reference level. A reference level $e_1$ of the comparator 22 is slightly higher than a reference level $e_2$ of the comparator 23 as shown in FIG. 5(*a*).

The comparators 22 to 29 produce a signal "1" when the coin detection waveshape levels applied thereto are higher than the set reference level applied thereto, which signal "1" is applied to a flip-flop 30 to set it. In case the coin diameter detection waveshape level 5*b*′ becomes lower than the reference level $e_2$, the comparator 23 will produce a signal "0". Accordingly, the flip-flop 30 is reset by this signal "0" via an inverter 31 to thus produce an output having a duration substantially corresponding to the time length of the coin diameter detection waveshape 5*b*′ as shown in FIG. 5(*b*).

Comparators 24 and 25 are of a similar construction to the comparators 22 and 23. Reference levels $e_3$ and $e_4$ are defined as levels in the vicinity of the bottom of the detection waveshapes 6*b*′ to 7*c*′ and are slightly different from each other in levels thereof.

As will hereinafter be described in detail, the circuit is so constructed that the reference levels $e_3$ and $e_4$ are not applied to the comparators 24 and 25 while the coin diameter detection waveshape 5*b*′ is produced whereby the comparators 24 and 25 are not in operation.

When the coin detection waveshapes exceed the reference level $e_3$ applied to the comparator 24, the flip-flop 32 is set, and when the detection waveshape falls below the reference level $e_4$ applied to the comparator 25, the flip-flop 32 is reset to produce an output having duration substantially corresponding to the time length of the coin detection waveshapes 6*b*′, 6*c*′, 7*b*′, 7*c*′ as shown in FIG. 5(*d*).

Since there exist different levels between the reference levels $e_1$ and $e_3$ for setting the flip-flops 30 and 32, respectively, and the reference levels $e_2$ and $e_4$ for resetting the flip-flops 30 and 32, respectively, a hysteresis characteristic is provided between the setting and resetting operations of the flip-flops 30 and 32. Therefore, even if the coin detection waveshapes obtained from the coin detectors 5, 6 and 7 are irregular, the flip-flops 30 and 32 can accurately produce one pulse per one detection waveshape. If the flip-flops 30 and 32 were set and reset with only one reference level, an irregular coin detection waveshape would frequently rise above and fall below the single reference level with a resulting repeatedly occurring setting and resetting of the flip-flops 30 and 32 and corresponding production of plurality of pulses for one detection wavehape. In order to prevent such undesirable repetition of setting and resetting of the flip-flops, this embodiment utilizes the hysteresis characteristic produced by two reference levels $e_1$ and $e_2$ or $e_3$ and $e_4$.

Comparators 26, 27 and 28, 29 respectively form pairs for setting upper and lower threshold levels of window circuits 33 and 34, respectively for discriminating the peak levels of the coin detection waveshapes. For example, assume that the window circuit 33 is constructed to detect the peak level of 10 yen coin detection waveshape, an upper limit reference level $H_1$ applied to the input of the comparator 26 is to set the upper limit value of the peak level of the 10 yen coin detection waveshape, while the lower limit reference level $L_1$ applied to the input of the comparator 27 is to set the lower limit value of the peak level of the 10 yen coin detection waveshape. In the meanwhile, assume that the window circuit 34 is constructed to detect the peak level of 50 yen coin detection waveshape, an upper limit reference level $H_2$ applied to the input of the comparator 28 is to set the upper limit value of the peak level of the 50 yen coin detection waveshape, while the lower limit reference level $L_2$ applied to the input of the comparator 29 is to set the lower limit value of the peak level of the 50 yen coin detection waveshape.

The respective reference levels $H_1$, $L_1$ and $H_2$, $L_2$ are sequentially switched to a value corresponding to the characteristic of the inserted coin to be detected by the coin detector as the inserted coins sequentially pass the coin detectors 5, 6 and 7. For example, in case of the window circuit 33 for 10 you coin, as shown in FIG. 5(*c*), the upper and lower reference levels $H_1$ and $L_1$ are switched sequentially as listed in Table 1 below in correspondence to the coin detection waveshapes of various characteristics of the inserted coin.

Table 1

| Characteristics of Inserted coin | Coin Detection Waveshapes | Reference Level $H_1$ | Reference Level $L_1$ |
|---|---|---|---|
| Diameter | 5b' | $e_5$ | $e_6$ |
| Material | 6b', 6c' | $e_7$ | $e_8$ |
| Surface Incuse Pattern & Shape | 7b', 7c' | $e_9$ | $e_{10}$ |

Similarly, the upper and lower reference levels $H_2$ and $L_2$ of the window circuit 34 for 50 yen coin are respectively switched sequentially in three values ($e_{11}$, $e_{12}$. . . , $e_{16}$) corresponding to the detection waveshapes of the respective characteristics of the inserted coin. The reference levels $e_1$ to $e_4$ and $H_1$ to $L_2$($e_5$ to $e_{16}$) for the respective comparators 22 to 29 are produced from a reference voltage generating circuit 35. Since the values of the reference levels $H_1$, $L_1$ or $H_2$ $L_2$ are applied sequentially as required, the circuit arrangement of this embodiment may have only one window circuit for each denomination even in case the detection waveshape peak levels are detected with respect to plural characteristics of the inserted coins (three characteristics in this embodiment).

The output signal "1" produced from the flip-flop 30 upon entry of a coin in the first coin detector 5 (see FIG. 5(*b*)) is applied to the input of an AND gate 36 to enable it. The AND gate 36 thereupon produces an output signal which is delivered to the input of a flip-flop 37 to set the same. To the other inputs of the AND gate 36 are applied a reset output $\overline{Q}$ of the flip-flop 37 and a receiving solenoid coil breakage detection signal $\overline{S}$, which signals are normally "1".

When the coil of the coin receiving solenoid 9 is broken, the signal $\overline{S}$ becomes "0" whereupon the AND gate 36 ceases to produce an output "1" thereby to prohibit the operation of the circuit shown in FIG. 4, for stopping a counting pulse therefrom.

The flip-flop 37 produces a set output, which is applied to a line 38 and also to the input of a flip-flop 39 to set the same. The flip-flop 39 produces a set output "1", which is applied to a timer 40 to set the same by the rise of the set output "1" from the flip-flop 39 to thus start the operation of the timer 40. The operation time $T_1$ of the timer 40 is defined as the time duration when the inserted coin passes the coin detection path 3 in the entire length thereof, i.e., all the coin detectors 5, 6 and 7 corresponding to the time required for completing detection of the characteristics of the inserted coin as shown in FIG. 5.

When the operation time $T_1$ of the timer 40 has passed, the timer 40 produces an output "1", which is applied to the input of the flip-flop 37 via an OR gate 4 to reset the flip-flop 37. Accordingly, the time when signal "1" is provided on the line 38 corresponds to the operation time $T_1$ of the timer 40. Further, the output signal "1" is also applied to a flip-flop 39 via an AND gate 42 and OR gates 43 to thus reset the same.

On the other hand, when a set output signal of the flip-flop 30 becomes "1", an AND gate 49 produces an output "1" since the set output from the flip-flop 37 and the reset output from a flip-flop 48 are "1" respectively. The output signal "1" from the AND gate 49 on a line 50 is applied to the initial stage $R_1$ of a shift register 52 via an OR gate 51 and stored in the initial stage $R_1$.

Then, when the inserted coin passes the initial coin detector 5, the output of the flip-flop 30 will fall to "0", as shown in FIG. 5(*b*), and the output signal "0" is applied to the input of a fall detection circuit 44 for generating one pulse. Thus, the circuit 44 produces one pulse upon receipt of the output signal "0" from the flip-flop 30. Similarly, fall detection circuits 44, 45, 46 and 47 produce one short pulse when the input signal has fallen from "1" to "0". The fall detection circuit 44 thus produces an output signal "1", which is applied to the flip-flop 48 to set the same and which is also applied to a flip-flop 54 via AND and OR gates 110 and 53 to reset the same.

When the output of the flip-flop 30 becomes "0", the AND gate 49 produces an output signal "0", which is applied on the line 50. Accordingly, the signal on the line 50 is corresponding to the output of the flip-flop 30 as shown in FIG. 5(*b*). The signal on the line 50 is applied to AND gates 55 and 56 to whereby the detected result of the diameter of the inserted coin is stored in the flip-flops connected to the post-stage of the AND gates 55 and 56. Accordingly, the signal "1" on the line 50 corresponds in duration to the operation time $TE_1$ for detecting the diameter of the inserted coin.

Operation of the circuit arrangement thus constructed will be described with reference to the window 33. The output of the upper limit threshold comparator 26 is applied to a NOR gate 57 and the output of the lower limit threshold comparator 27 is applied to the set input of a flip-flop 58. When the inserted coin diameter waveshape 5*b'* exceeds the lower limit reference level $L_1$ ($e_6$), the flip-flop 58 is thereby set. As a result, the reset output $\overline{Q}$ becomes "0".

In case the peak level of the detection waveshape 5*b'* does not exceed the upper limit reference level $H_1$ ($e_5$), the output of the comparator 26 is "0", which is applied to the other input of the NOR gate 57 which produces an output "1".

When the detection waveshape 5*b'* almost finishes its operation time, the flip-flop 30 is reset as was described above, so that the reset output "1" from the flip-flop 30 is applied to the input of the flip-flop 58 via an AND gate 59 to reset the same. Thus, the output of NOR gate 57 becomes "0". Accordingly the fall pulse generation circuit 46 produces one pulse, which is applied to the inputs of the AND gates 55, 60 and 61.

Since this time is in the coin diameter detection period $TE_1$ (or immediately before the end of the period $TE_1$), wherein signal on the line 50 is "1" and the signal on the line 38 is also "1", the output pulse of the fall pulse detection circuit 46 set a 10 yen coin diameter memory flip-flop 63 via the AND gates 55 and 62. Accordingly, when the inserted coin is detected to be true, the signal "1" is thus stored in the flip-flop 63.

In the meanwhile, in case the peak level of the detection waveshape 5*b'* does not come between the upper and lower limit threshold levels $H_1$ and $L_1$ ($e_5$ and $e_6$), particularly when the peak level exceeds the upper limit standard level $H_1$ ($e_5$), the comparator 26 produces an output "1" which is applied to the input of the NOR gate 57 which thereupon produces an output "0". Thus, when the detection waveshape 5*b'* falls, the comparator 26 produces an output "0", which is applied to the input of the NOR gate 57 which produces an output rising again to "1", while when the reset-output "1" of the flip-flop 58 is applied to the input of the NOR gate 57, the NOR gate 57 produces an output falling again to "0".

Thus, in case the peak value of the detection waveshape 5*b'* is higher than the upper limit reference value $H_1$ of the window circuit 33 (or 34), two or more pulse are produced from the fall detection circuit 46 during the inserted coin detection period $TE_1$. In this case the flip-flop 63 is set by the initial pulse applied thereto, but is reset by the following pulse via an AND gate 64. All the flip-flops including the flip-flop 63 used in this embodiment are of a reset precedence type. Accordingly, the flip-flop 63 is preferentially reset with two pulses, even if set input is simultaneously applied thereto.

Therefore, even if two or more pulses are generated during the period $TE_1$, the flip-flop 54 is set by the second pulse via the AND gate 64 and thus produces a reset output '0', which is applied to the input of the AND gate 62 to cause the flip-flop 63 to cease to produce the third and subsequent pulses by disenabling of the AND gate 62. Accordingly, in case the peak level of the coin detection waveshape does not come between the upper and lower limit threshold levels of the window circuit, the detected result memory flip-flop 63 (or 64, 65, 66, 67 68 and 69) stores the signal "0". Therefore, the flip-flop 54 substantially cooperates with the discriminating operations of the window circuits 33 and 34.

The signal "1" of the first stage $R_1$ of the shift register 52 is applied to the AND gate 15 and the reference voltage generating circuit 35 via an OR gate 70 to supply the excitation frequency $f_2$ to the primary winding coil 6*a* of the coin detector 6 via the AND gate 15. Thus, the second coin detector 6 becomes capable of detecting and thus produces the coin detection waveshapes 6*b'* and 6*c'* as the inserted coin pass therethrough via the coin detector 5. At this time the reference voltage generating circuit 35 receives the alternating frequency signal $f_2$ delivered to the coil 6*a* via the AND gate 15 to generate DC reference voltages $e_7$, $e_8$ and $e_{13}$, $e_{18}$ to thus convert the output levels $H_1$, $L_1$ and $H_2$, $L_2$ to the voltages $e_7$, $e_8$ and $e_{13}$, $e_{14}$ upon receipt of the signal from the OR gate 70. Similarly, when the voltage generating circuit 35 receives the alternating frequency signal $f_2$ or $f_3$, it generates the standard voltages $e_3$, $e_4$, which are applied to the comparators 24, 25, respectively.

As shown in FIG. 5(*d*), the flip-flop 32 produces an output substantially corresponding to the time duration of the coin detection waveshapes 6*b'*, 6*c'*, which output is applied to the fall detection circuit 45 which produces a short pulse responsive to the fall of the pulse. At this time, since the signal on the line 50 has already fallen to "0", which is applied to the inhibit gate input of an AND gate 71 which produces a pulse responsive to the fallen pulse, which pulse is applied to the shift register 52 via the OR gate 51 to cause the shift register 52 to shift the signal "1" in the initial stage $R_1$ thereof to the second stage. The shift register 52 in this embodiment has a function to successively shift the signal "1" initially read from the OR gate 51 to the subsequent stages upon receipt of the pulse from the OR gate 51. Thus, when the coin detection waveshape 6*b'* has substantially completed its operation time, the signal "1" in the initial stage of the shift register 52 is shifted to the second stage $R_2$. The output "1" of the second stage $R_2$ is applied to the primary coil 6*a* of the coin detector 6 via the OR gate 70 and gate 15 to continue the excitation of the coil 6*a* of the frequency $f_2$ and to apply the signal "1" to a line 72.

Thus, the window circuit 33 or 34 operates as described before to detect the peak level with respect to the material of the inserted coin and to produce one pulse per one coin detection waveshape in case the inserted coin is detected to be true. When the peak level of the coin detection waveshape 6*c'* is detected to be true for the inserted coin, since the signal "1" is applied on the line 72 from the second stage $R_2$ of the shift register 52, the signal "1" is applied to the 10 yen coin material detected result memory flip-flop 65 (68 in case of 50 yen coin) via the AND gate 60 (73 in case of 50 yen coin) and an AND gate 78 (79 in case of 50 yen coin) to cause the flip-flop 65 (or 68) to store the signal "1".

When the coin detection waveshape 6*c'* is substantially completed, the shift register 52 receives the output pulse from the fall detection circuit 45 via the AND gate 71 and the OR gate 51 to cause the shift register 52 to shift the signal "1" in the second stage thereof to the third stage $R_3$. The AND gate 15 therefore is disenabled. In the meanwhile, the flip-flop 54 is reset through an AND gate 74 having an inhibit gate for a signal on the line 50 each time the detection waveshape is nearly completed.

The signal "1" of the third stage $R_3$ of the shift register 52 is applied to the AND gate 16 and the reference voltage generating circuit 35 via an OR gate 75 to supply the excitation frequency $f_3$ to the primary winding coil 7*a* of the coin detector 7 via the AND gate 16. Thus, the third or last coin detector 7 in the coin detection path becomes capable of detection and thus produces the coin detection waveshapes 7*b'* and 7*c'* as the inserted coin passes therethrough via the coin detector 6. At this time, the reference voltage generating circuit 35 receives the alternating frequency signal $f_3$ delivered to the coil 7*a* via the AND gate 16 to generate DC reference voltages $e_9$, $e_{10}$ and $e_{15}$, $e_{16}$ on the basis of the signal $f_3$ to thus convert the output levels $H_1$, $L_1$ and $H_2$, $L_2$ to the voltages $e_9$, $e_{10}$ and $e_{15}$, $e_{16}$ upon receipt of the signal from the OR gate 75.

Therefore, the flip-flop 32 produces an output substantially corresponding to the time duration of the coin detection waveshapes 7*b'*, 7*c'* as shown in FIG. 5(*d*).

Then, the window circuit 33 or 34 operates as described before to detect the peak level with respect to the surface incuse pattern and shape of the inserted coin. When the coin detection waveshape *7b'* is substantially completed, the shift register 52 receives the output pulse from the fall pulse generation circuit 46 via the AND gate 71 and the OR gate 51 to cause the shift register 52 to shift the signal "1" in the third stage thereof to the fourth stage $R_4$. Thus, the signal "1" from the fourth stage of the shift register 52 is applied on a line 76.

Accordingly, when the peak level of the inserted coin detection waveshape *7c'* is detected to be correct for the inserted coin, since the signal "1" is applied on line 76 from the fourth stage $R_4$ of the shift register 52, the signal "1" is applied to the 10 yen coin surface incuse pattern and shape detected result memory flip-flop 66 (69 in case of 50 yen coin) via the AND gate 61 (77 in case of 50 yen coin) to cause the flip-flop 66 (or 69) to store the signal "1".

When the final coin detection waveshape *7c'* is substantially completed, the shift register 52 receives the output pulse from the fall pulse generation circuit 45 via the AND gate 71 and the OR gate 51 to cause the shift register 52 to shift the signal "1" in the fourth stage thereof to the final fifth stage $R_5$. Thus, the application of the signal "1" of the fourth stage of the shift register 52 to the AND gate 16 is stopped resulting in application of only the excitation frequency $f_1$ to the primary coil 5*a* of the coin detector 5 to cause the coin detection path to wait for a coin to be inserted nextly.

The reference voltage generating circuit 35 is constructed to produce the reference voltages $e_1$, $e_2$, $e_5$, $e_6$, $e_{11}$, $e_{12}$ upon receipt of the alternating current signal $f_1$ applied to the primary coil 5*a* of the initial coin detector 5 even upon receipt of the signal "0" from the OR circuit 70 ro 75 to apply the voltages to the comparators 22, 23, 26 to 29.

When the operation time $T_1$ of the timer 40 is completed, the signal on the line 38 becomes "0", but the coin detection has already finished at this time, so that the detected results are stored in the flip-flops 63, 65, 66 or 67, 68, 69. In case all the characteristics of the inserted coin thus detected are found to be correct, the flip-flops 63, 65 and 66 produce respective outputs "1" in case of a 10 yen coin to cause an AND gate 82 to produce an output "1" and the flip-flops 67 to 69 produce respective outputs "1" in case of a 50 yen coin to cause an AND gate 83 to produce an output "1".

The output "1" of the AND gate 82 is applied to the input of an AND gate 84 and the inhibit gate input of an AND gate 85, and the output "1" of the AND gate 83 is applied to the input of the AND gate 85 and the inhibit gate input of the AND gate 84 so as to prevent simultaneous delivery of true coin detection signals for coins of different denominations. In addition, the output of the final fifth stage $R_5$ of the shift register 52 is applied to the other respective inputs of the AND gates 84 and 85 to cause the AND gates 84 and 85 to produce its outputs only when all the coin detection operations have been completed.

Thus, the AND gates 84 or 85 produces outputs "1", respectively as true coin detection signal representing that the inserted coin should be received in the coin receiving apparatus. The output of the AND gate 84 or 85 is applied to 10 yen or 50 yen coin insertion number counter 88 or 89 via AND gate 86 or 87, respectively for counting the number of the inserted coins. The results of counting by the counters 88 and 89 are utilized in a vend control circuit (not shown) of a vending machine for various operations including vending operation and change payout operation.

Then, the output of the AND gates 84 or 85 is applied to a coin insertion number control section 90 and is counted thereby to cause the control section 90 to produce an output "0" when the result of counting in a single purchase exceeds the upper limit number of the inserted coins thereby preventing receipt of subsequently inserted coins even if the subsequently inserted coins have been judged to be true. This control section 90 produces an output "1" only when a true coin is inserted in the apparatus, and produces an output "0" when a false coin is inserted or when an excessive number of coins are inserted therein.

In addition, the true coin insertion signal from the AND gates 84 or 85 is applied to a flip-flop 93 via an OR gate 91 and an AND gate 92 to cause the flip-flop 93 to be set.

The flip-flop 93 produces a set output "1" which is applied to the input of an AND gate 94 and also to the set input of a flip-flop 95 to cause the flip-flop 95 to be set so as to start the operation of a timer 96. The timer 96 normally produces an output "0" and produces an output "1" when the timer operation time is completed. The output of the timer 96 is applied to the inhibit gate input of the AND gate 94, which produces an output "1" simultaneously when the flip-flop 93 is set, which output is applied to the receiving solenoid 9 (see FIG. 3) to cause the flip-flop 93 to energize the solenoid 9. This energization of the solenoid 9 is continued until the operation time of the timer 96 is completed. Therefore, the receiving projection 10 pulled by the solenoid 9 will close the opening 11 in the coin path to allow the true coin inserted to be received in the true coin path 13 when the inserted coin is detected to be true as soon as the inserted coin passes the final coin detector 7 (see FIG. 1).

The operation time $T_2$ of the timer 96 is a period of time corresponding to the time interval between the sequential coin insertion when the coins are sequentially inserted with a proper interval. When a following coin passes the coin detector 7 during the operation time of the timer 96, the signal of the fourth stage $R_4$ of the shift register 52 becomes "1", which is applied to the reset input of the flip-flop 95 to forcibly reset the flip-flop 95 since the flip-flop 95 is of a reset precedence type. If the inserted coin is detected to be true, the signal "1" from the flip-flop 93 is applied to the set input of the flip-flop 95 to cause the flip-flop 95 to be set immediately upon falling of the reset input thereof to "0" and to cause the input of the timer 96 to rise. Thus, the operation time of the timer is again started from the beginning.

Therefore, when the coins are sequentially inserted in the coin receiving apparatus and are detected to be true, the timer 96 produces continuously an output "0" without interruption to cause the solenoid 9 to be continuously energized. If a following coin has been detected to be false among continuously inserted coins, the output of the final stage $R_5$ of the shift register 52 is applied to the input of an AND gate 106 and the output "0" of the control section 90 is applied to the inhibit gate input of the AND gate 106 to cause the AND gate 106 to produce an output "1", which is applied to the reset input of the flip-flop 93 to cause the flip-flop 93 to be reset but not to cause the flip-flop 95 to be set.

When the operation time of the timer 96 is completed, the output "1" of the timer 96 is applied to the input of the AND gate 97 to cause the AND gate 97 to produce an output "1", which is applied to the reset input of the flip-flop 93 via an OR gate 98 to cause the flip-flop 93 to be reset. In the event that the solenoid 9 is defective does not produce a signal, the signal "1" is applied on a line 99 and is applied to the set input of a flip-flop 101 via an AND gate 100 to cause the flip-flop 101 to be set to produce a trouble signal ST therefrom.

The output of the final stage $R_5$ of the shift register 52 is applied to a reset signal register (not shown) via a delay circuit 102 to cause the reset signal register to produce a reset signal. This reset signal is provided to reset the memory in the flip-flops of the coin receiving apparatus shown in FIG. 4, and the delay circuit 102 produces one reset signal every time when one inserted coin is completely detected.

The prevention of receiving coins inserted without a sufficient interval will now be described. In case the coin previously inserted in the apparatus is still retained in the coin detection path 3, the signal "1" remains in any of the stages $R_1$ to $R_4$ of the shift register 52 and signal "0" is in the final stage $R_5$ of the register 52. Accordingly, the signal "0" from the final stage $R_5$ of the shift register 52 is applied to the inhibit gate input of an AND gate 103. In the meanwhile, if the coin diameter detection time $TE_1$ of the coin previously inserted has completed, the AND gate 49 produces an output "0", which is applied to the other inhibit gate input of the AND gate 103.

In case two or more coins are inserted in too rapid succession in the coin detection path 3 of the receiving apparatus, the flip-flop 30 produces an output "1", which is applied to the input of the AND gate 103 which produces an output "1" therefrom. Thus, when the successive insertion of two or more coins without a sufficient interval has been detected, the output of the AND gate 103 is applied to the set input of the flip-flop 104 to cause the flip-flop 104 to be set, and the flip-flop 104 produces a set output "1", which is applied to the reset signal register (not shown), which produces the reset signal. This reset signal is applied to the respective flip-flops particularly flip-flops 63 to 69 shown in FIG. 4 to cause the flip-flop to be reset. Accordingly, detection of the inserted coins is not made and the receiving solenoid 9 is not energized, and all the coins inserted without a sufficient interval are returned to the return path 12.

When the final one of the successively inserted coins passes the initial coin detector 5, the output "1" of the AND gate 105 is applied to the reset input of the flip-flop 39 via the OR gate 43 to cause the flip-flop 39 to be reset. However, if the output of the OR gate 43 is returned to "0", since the output of the flip-flop 37 is "1", this output is applied to the set input of the flip-flop 39 to cause the flip-flop 39 to be set at once.

Therefore, the output of the flip-flop 39 is applied to the timer 40 to cause the timer to return to the original timer operation by the rise of the output of the flip-flop 39 to resume the operation time $T_1$. Thus, the timer 40 continues to operate while two more coins are successively inserted in the apparatus, and the timer 40 will complete the timing operation when the operation time $T_1$ has elapsed from the time when two or more coins are rapidly and successively inserted in the apparatus and final coin of the successively inserted coins passes the coin detection path 3, and thus produces an output "1", which is applied to the reset input of the flip-flop 104 to cancel the generation of the reset signal.

Thus, resetting of the flip-flops 63, 65 to 69, etc. for detecting the inserted coin in the apparatus is cancelled and all the flip-flops can now normally operate. Thus, the operation of the timer 40 is extended to cause the control circuit arrangement to start the normal operation of the respective circuits shown in FIG. 4 after the final one of the coins inserted in too rapid succession is returned to the return path 12 without fail.

For convenience of description, 10 yen and 50 yen coins are made object for detecting in the above embodiment. It will be understood, however, that coins of any denomination may be selected as object of detection in the coin receiving apparatus of this invention.

It will be appreciated that although the aforesaid embodiment employs a transformer type coin diameter detector 5, a differential transformer type detector having a secondary winding coil connected in opposite series may also be used.

It will also be appreciated that instead of the shift register 52 this invention may employ a counter and decoder or combination of plural flip-flops and logic gates as counting circuits.

Figure 6:
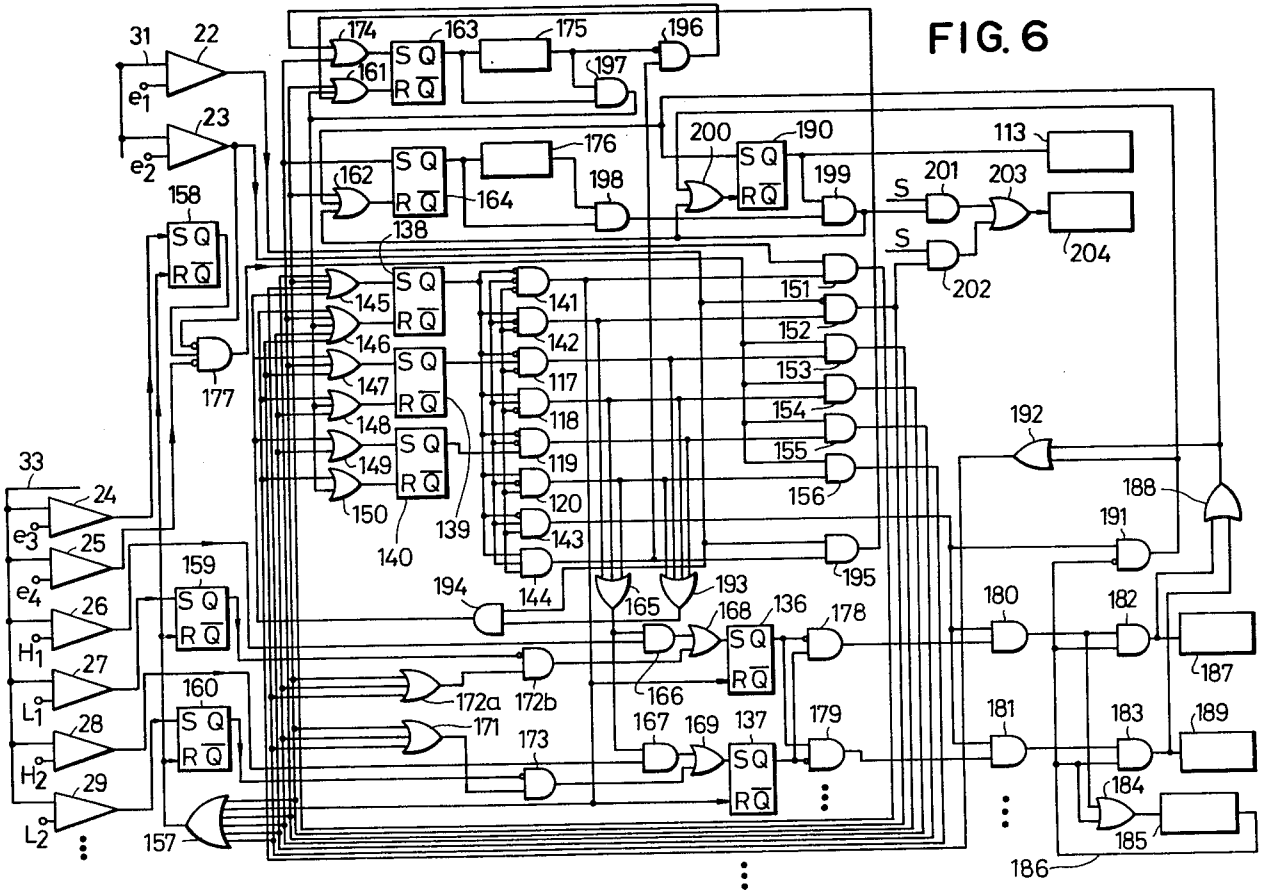
FIG. 6 is a block diagram showing another embodiment of the coin receiving apparatus according to the invention.

FIG. 6 shows another preferred embodiment of the coin receiving apparatus of this invention, wherein the same parts and components as those shown in FIG. 4 are designated by like reference numerals and characters and the description thereof is omitted. Flip-flop 136 is a memory for storing the detected result of the characteristics of the inserted 10 yen coin, and a flip-flop 137 is a memory for storing the detected result of the characteristics of the inserted 50 yen coin. Flip-flops 138, 139, 140 AND gates 141, 142, 117, 118, 119, 120, 143 having inhibit gate input and AND gate 144 form a counting circuit for conducting a series of detecting operations in response to the passage of the inserted coin in the coin detection path. OR gates 145 to 150 form input gates for advancing or varying the steps of the counting circuit.

It should be noted that all the flip-flops used in the embodiment shown in FIG. 6 are of a reset precedence type wherein resetting operation is preferentially conducted when setting and resetting inputs are simultaneously applied to the flip-flops.

Since all the flip-flops 138 to 140 are reset is a standby state before insertion of a coin, the AND gate 141 whose inputs are all inhibit gates produces an output "1", which is applied to the input of an AND gate 151 to cause the AND gate 151 to produce an output in a case of a coin insertion. The output "1" of the AND gate 141 is also applied to the reset inputs of the flip-flops 136 and 137 and also to the reset inputs of flip-flops 158, 159 and 160 via an OR gate 157 to cause all the flip-flops 136, 137, 158 to 160 to be reset.

In this stand-by state, if the inserted coin passes the initial coin detector 5 (see FIG. 4), the output of a comparator 22 is applied to the AND gate 151, which produces an output "1", which is applied to the flip-flop 138 via the OR gate 145 to cause the flip-flop 138 to be set. Simultaneously, the output "1" from the AND gate 151 is applied also to flip-flops 163 and 164 via the OR circuits 161 and 162 to cause the flip-flops 163 and 164 to be reset.

When the flip-flop 138 is thus set, the set output "1" is applied to the inhibit gate input of the AND gate 141 to cause the AND gate 141 to produce an output "0" and is also applied to the input of the AND gate 142 to cause the AND gate 142 to produce an output "1".

Figure 7:
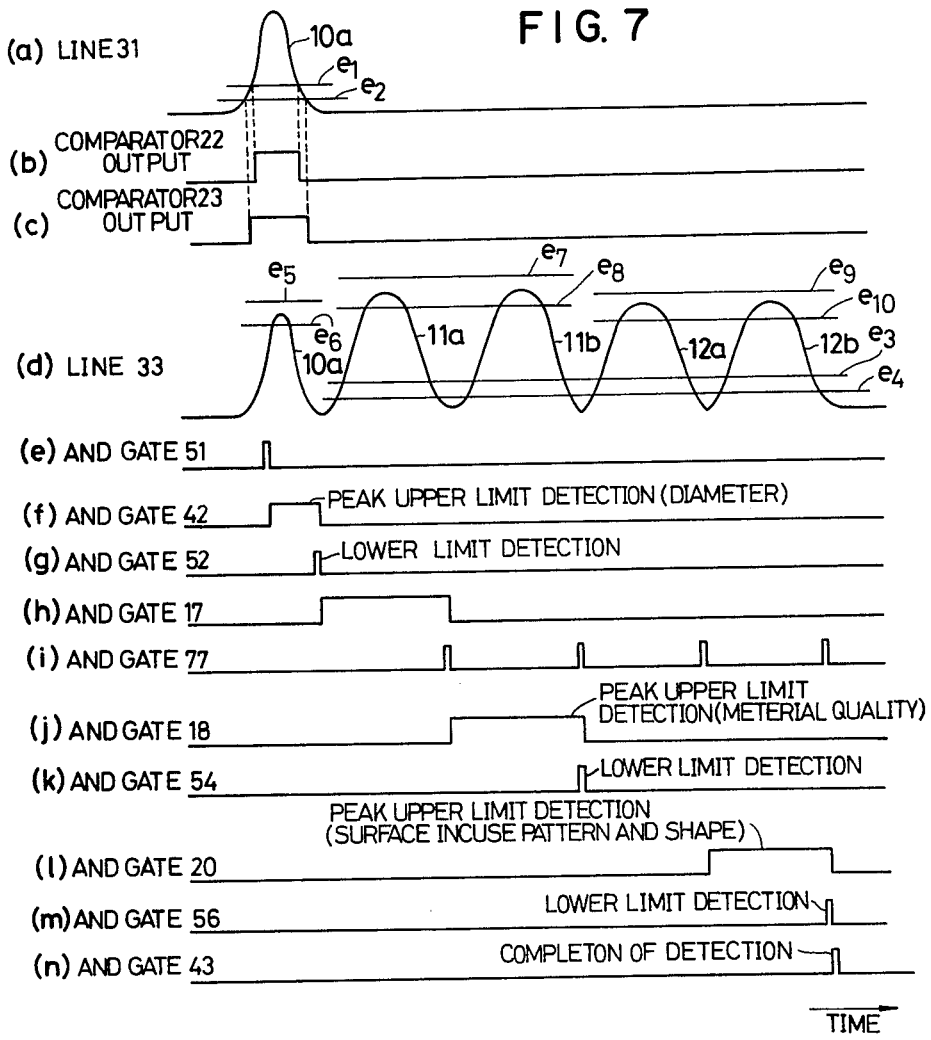
FIG. 7 is a timing chart showing waveforms of outputs from respective portions of the apparatus shown in FIG. 6.

As shown in FIG. 7(*e*), the output of the AND 151 falls to "0", while as shown in FIG. 7(*f*), the output of the AND gate 142 rises to "1". The output "1" of the AND gate 142 is applied to the AND gates 166 and 167 via an OR gate 165.

In case the peak level of the coin diameter detection waveshape 10*a* produced at this time exceeds the upper limit reference levels $H_1$ or $H_2$, the comparators 26 or 28 produces output "1", which is applied to the input of the AND gates 166 or 167, to cause the AND gates 166 or 167 to produce output "1", which is applied to the set input of the flip-flop 136 or 137, via OR gates 168 or 169, respectively to cause the flip-flops 136 or 137 to be set. Thus, the peak level of the coin detection waveshape 10*a* of the inserted coin is detected as to the upper limit thereof at this time.

In case the detection waveshape 10*a* becomes lower than the reference level $e_2$, the comparator 23 produces an output "0", which is applied to the inhibit gate input of the AND gate 152 to cause the AND gate 152 to produce an output "1". The output "1" from the AND gate 152 is applied to the inputs of AND gates 172*b* and 173 via OR gates 172*a* and 171.

When the peak level of the coin diameter detection waveshape 10*a* does not exceed the lower limit reference level $L_1$ or $L_2$, the comparator 27 or 29 produces output "0", which is applied to the input of the flip-flop 159 or 161, whereby the flip-flop 159 or 161 is not set.

If the peak level of the detection waveshape 10*a* exceeds the lower limit level $L_1$ or $L_2$, the comparators 27 or 29 produces output "1", which is applied to the set input of the flip-flops 159 or 160, to cause the flip-flops 159 or 160 to be set.

Therefore, if the inserted coin is detected to be false, the flip-flops 159 and 160 produce outputs "0", which are applied to the inhibit gate inputs of the AND gates 172*b* and 173 via the OR gates 172*a* and 171 to cause the AND gates 172*b* and 173 to produce outputs "1", which are applied to the set inputs of the flip-flops 136 and 137, respectively via the OR gates 168 and 169 to cause the flip-flops 136 and 137 to be set.

As shown in FIG. 7(*g*), when the output of the AND gate 152 produces an output "1", the detection of the peak level of the coin diameter detection waveshape 10*a* is completed. In case the peak level is between the upper and lower limit reference levels $H_1$, $H_2$ and $L_1$, $L_2$ or when the inserted coin is detected to be true, the flip-flop 136 or 137 are not set. For example, in case a 10 yen coin is inserted, the flip-flop 136 is not set, but the flip-flop 137 is set in case of 50 yen coin inserted.

Thus, false coin detection signal is stored in the 50 yen coin detection result memory flip-flop 137. Accordingly, only the flop-flop 136 in case of 10 yen coin inserted will now be described.

The output "1" from the AND gate 152 is applied to the reset input of the flip-flop 138 via the OR gate 146 to cause the flip-flop 138 to be reset and is also applied to the set input of the flip-flop 139 via the OR gate 147 to cause the flip-flop 139 to be set. Simultaneously, the output "1" of the AND gate 152 is also applied to the set input of the flip-flop 163 via an OR gate 174 to cause the flip-flop 163 to be set and is also applied to the set input of the flip-flop 164 to cause the flip-flop 164 to be set.

If the flip-flops 163 and 164 are thus set, they produce outputs "1", which are applied to timers 175 and 176, respectively to cause the timers 175 and 176 to start operations. The timers 175 and 176 produce outputs "0" during the operation time and produce outputs "1" when the operation time is completed. As to these timers 175 and 176 detailed description will be made later.

When the flip-flop 139 is set, the AND gate 117 produces an output "1". This output "1" is applied to the input of the AND gate 153. To the other input of the AND gate 153 is applied the output from an AND gate 177. Further, the output from the comparator 123 is applied to one inhibit gate input of the AND gate 177.

When the coin detection waveshape 11*a* is applied to the input of the comparator 24, which produces an output "1", which is applied to the set input of the flip-flop 158 to cause the flip-flop 158 to be set. Thus, the flip-flop 158 produces an output "1", which is applied to the input of the AND gate 177.

In case the level of the detection waveshape 11*a* becomes lower than the lower limit reference level $e_4$, the comparator 25 produces an output "0", which is applied to the inhibit gate input of the AND gate 177, which produces an output "1", which is applied to the input of the AND gate 153 to cause the AND gate 153 to produce an output "1". The output "1" from the AND gate 153 is applied to the reset inputs of the flip-flops 158 to 160 via the OR gate 157 to cause the flip-flops 158 to 160 to be reset and is also applied to the set input of the flip-flop 138 via the OR gate 145 to cause the flip-flop 138 to be set. Thus, the flip-flop 138 produces an output "1", which is applied to the input of the AND gate 118 to cause the AND gate 118 to produce an output "1".

As shown in FIG. 7(*j*), when the AND gate 118 produces the output "1", the following detection step is started. The output "1" from the AND gate 118 is applied to the inputs of the AND gates 166 and 167 via the OR gate 165.

Likewise, if the peak level of the coin material detection waveshape 11*b* exceeds the upper limit reference level, the comparator 26 or 28 produces an output "1", which is applied to the set input of the flip-flop 136 or 137 to cause the flip-flop 136 or 137 to be set.

If the peak level of the coin detection waveshape 11*b* does not exceed the upper limit reference level, the comparator 126 or 128 produces an output "0", which is applied to the set input of the flip-flop 136 or 137 to prevent the flip-flop 136 or 137 from being set.

In case the peak level of the detection waveshape 11*b* becomes lower than the lower limit reference level $e_4$, as shown in FIG. 7(*i*), the AND gate 177 produces an output "1", which is applied to the input of the AND gate 154 to cause the AND gate 154 to produce an output "1". The output "1" from the AND gate 154 is applied to the AND gates 172*b* and 173 via the OR gates 172*a* and 171.

Similarly to the above operation, since the result of detection of the inserted coins as to the lower limit reference level with respect to the peak level of the detection waveshape are stored in the flip-flops 159 and 160, these results are then applied to the set inputs of the flip-flops 136 and 137. Thus, in case the peak level of the detection waveshape 11*b* is between the upper and lower limit reference levels $e_7$ and $e_8$, the flip-flop 136 is not set.

As described above, the flip-flop 137 once set as to 50 yen coin detection remains set. The output "1" from the AND gate 154 is applied to the reset input of the flip-flop 138 via the OR gate 146 to cause the flip-flop 138 to be reset and is applied to the reset input of the flip-flop 139 via the OR gate 148 to cause the flip-flop 139 to be reset. The output "1" from the AND gate 154 is also applied to the flip-flop 140 via the OR gate 149 to reset the flip-flop 140. Accordingly, the output "1" of the flip-flop 140 is applied to the input of the AND gate 119 to cause the AND gate to produce an output "1".

The period of time when the AND gate 119 produces an output "1" substantially corresponds to the time when the detection waveshape 12*a* is produced from the coin detector 7 (see FIG. 4). If the level of the detection waveshape 12*a* becomes lower than the reference level $e_4$, the AND gate 177 produces an output "1", which is applied to the input of the AND gate 155 to cause the AND gate 155 to produce an output "1", which is applied to the input of the flip-flop 138 via the OR gate 145 to cause the flip-flop 138 to be set.

Thus, the AND gate 120 produces an output "1" this time, and then the following detection step is initiated. When the AND gate 120 produces an output "1", this output is applied to the OR gates 166 and 167 via the OR gate 165. At this time detection is made as to whether the peak level of the inserted coin surface incuse pattern and shape detection waveshape 12*b* exceeds the upper limit reference level or not.

The detected results as to whether the peak level of the detection waveshape 12*b* is higher or lower than the lower limit reference level has been stored in the flip-flops 159 and 160. Accordingly, the AND gate 177 produces an output "1" at the end of the detection waveshape 12*b*, and when the AND gate 156 produces an output "1". The stored contents of the flip-flops 159 and 160 are delivered to the flip-flops 136 and 137 via the OR gates 170, 171 and AND gates 172*b*, 173. Thus, all detection operations as to the three kinds of coin characteristics are completed at this time. More specifically, in case a result of detection with respect to even one of the characteristics of the inserted coin shows that the coin is false, a signal "1" is stored in the flip-flops 136 and 137. For example, in case the inserted coin is a true 10 yen coin, the output of the flip-flop 136 is "0" after the time when the pulse is applied thereto as shown in FIG. 2(*m*), while the output of the flip-flop 137 as to 50 yen coin is "1". Accordingly, the output of the AND gate 178 to which the output of the flip-flop 136 is applied at the inhibit gate input thereof is "1", while the output of the AND gate 179 to which the output of the flop-flop 137 is applied at the inhibit gate input thereof is "0".

The output from the AND gate 156 shown in FIG. 7 (*m*) is applied to the flip-flop 138 via the OR gate 146 to reset the same and thereby set the flip-flop 139 via the OR gate 147. Accordingly, the output of the AND gate 143 becomes "1", which is applied to the AND gates 180 and 181. At this time finally detected results are delivered from the AND gates 178 and 179 to the AND gates 180 and 181. The true coin detection signal "1" is applied to the AND gates 182 or 183 and OR gate 184. An inserted coin number control section 185 is constructed to count the number of the true coins inserted in the apparatus for controlling the total number of the inserted coins inserted in a single purchase.

When the inserted coins have been found true, the signal "1" is applied from the inserted coin number control section 185 on an output line 186 to cause the AND gates 182 and 183 to rpdouce outputs "1".

In case the inserted coins have not been found true, the signal "0" is applied from the coin number control section 185 on the line 186.

Thus, true 10 yen coin detection pulse is delivered to an inserted total 10 yen coin amount counter 187, while true 50 yen coin detection pulse is applied to an inserted total 50 yen coin amount counter 189 for counting the number of the inserted coins.

The true coin receipt signal from the AND gates 182 or 183 is applied to a flip-flop 190 via an OR gate 188 to cause the flip-flop 190 to be set. The flip-flop 190 thus produces a set output, which is applied to the receiving solenoid 113 to cause the solenoid 113 to be energized. This energization of the solenoid 113 will mechanically classify the inserted coins into the coin receiving path.

In case the inserted coin has been detected false, the solenoid 113 is not energized and the inserted coin is mechanically introduced to the coin return path. Thus, in case a false coin has been inserted, the output of the AND gate 191 having an inhibit gate becomes "1" at the timing of the output of the AND gate 143 as shown in FIG. 7(*n*) (because the output on the line 186 is "0") which is applied to the reset input of the flip-flop 190 to cause the flip-flop 190 to be reset. Thus, the solenoid 113 is not energized.

Thus, upon completion of the detection, the output of the OR gate 188 or the AND gate 191 is applied to the OR gate 192, which thereupon produces an output, which is applied to the reset inputs of the flip-flops 138 to 140 via the OR gates 146, 148 and 150 to cause the flip-flop 138 to 140 to be reset so as to restore the apparatus to a stand-by state.

If the following coin is erroneously inserted into the coin detection path to operate any of the coin detectors while the coin previously inserted is still passing in the coin detection path and is being detected by any of the coin detectors, i.e., insertion of two coins in rapid succession has occurred, the detected results as to the two coins will be delivered to the flip-flops 136 or 137 and the apparatus will not be able to accurately detect whether the coin is true or false.

The embodiment of the coin receiving apparatus of this invention is constructed to return all the coins thus inserted successively without a proper interval by resetting the apparatus.

The operation of this circuit arrangement will now be described in detail. When the coin previously inserted is passing the coin detector 6 or 7 in the coin detection path, one of the AND gates 117 to 120 produces an output "1", which is applied to the input of the OR gate 193 to cause the OR gate 193 to produce an output "1".

When two or more coins are successively inserted without a sufficient interval in the coin detection path at this time, the comparator 23 produces an output "1", which is applied to the input of the AND gate 194. To the other input of the AND gate 194 is applied the output of the OR gate 193. Thus, the AND gate 194 produces an output "1", which is applied to all the flip-flops 138 to 140 via the OR gates 145, 147 and 149. Accordingly, the output "1" of the AND gate 144 is applied to the input of an AND gate 195 to cause the AND gate 195 to produce an output "1" so as to reset the flip-flop 163 via the OR gate 161.

Accordingly, in the case of the successive insertion of two or more coins without sufficient interval the AND gates 151 to 156 do not produce any output, but only the AND gate 195 produces an output "1". When the final coin of the successively inserted coins passes the initial coin detector 5, the AND gate 195 produces an output "0", which is applied to the input of the OR gate 161. The output "1" of the AND gate 144 is applied to the input of the AND gate 196 and the output "0" of the timer 175 is applied to the inhibit gate input of the AND gate 196. Therefore the AND gate 196 produces an output "1", which is applied to the input of the flip-flop 163 via the OR gate 174 to cause the flip-flop 163 to be set. Thus, the flip-flop 163 produces its output "1", which is applied to the timer 175 to start the timer 175.

When the operation time $T_1$ of the timer 175 is over, the timer 175 produces an output "1", which is applied to the input of an AND gate 197 to cause the AND gate to produce an output "1", which is applied to the reset input of the flip-flop 163 via the OR gate 161 to cause the flip-flop 163 to be reset. The output of the AND gate 197 is also applied to all the flip-flops 138 to 140 via the OR gates 146, 148 and 150 to cause all the flip-flops 138 to 140 be reset. Thus, the coin receiving apparatus is brought into a stand-by state.

The operation time $T_1$ of the timer 175 is so set as to be at least equal to the time required for passing of the inserted coin through all the coin detectors 5 to 7. Accordingly, the operation timer of the timer 175 is completed after the completion of the passage of the last one of the successively inserted coins through the final coin detector 7, and the flip-dlops 138 to 140 are thereby reset.

In case the true coins are sequentially inserted with a sufficient interval, the receiving solenoid 113 is continuously energized so that frequent repetition of energization and deenergization thereof will be avoided.

The operation time $T_2$ of the timer 176 is so set as to be longer than the timer from setting of the flip-flop 164 at the end of the initial detection waveshape 10*a* to completion of passage of the inserted coin through the last coin detector 7 and to be shorter than the time from setting of the flip-flop 164 to reaching of the coin to the sorting mechanism (at the position of the solenoid 113).

Accordingly, when the true coins are sequentially inserted in the receiving apparatus, the flip-flop 164 is reset by the coin receipt pulse from the OR gate 188 via the OR gate 162 before the operation time of the timer 176 is completed and the AND gate 198 is not enabled. Thus, the flip-flop 190 for energizing the solenoid 113 remains set to cause the solenoid 113 to be continuously energized. Accordingly, the coins sequentially inserted in the apparatus are successively received in the true coin receiving path.

In case a false coin is inserted after a true coin, the AND gate 198 produces an output "1", which is applied to the input of an AND gate 199 to cause the AND gate 199 to produce an output "1", which is also applied to the reset input of the flip-flop 190 via an OR gate 200 to cause the flip-flop 190 to be reset.

When the false coin is inserted in the coin receiving apparatus, the AND gate 191 produces an output "1", which is applied to the flip-flop 190 via the OR gate 200 to cause the flip-flop 190 to be reset.

If the false coin is inserted after the true coin, the solenoid 113 is deenergized before the false coin reaches the coin sorting mechanism, and in case the true coin is successively inserted after the true coin, the flip-flop 190 produces an output "1", which is applied to the solenoid 113 to continuously deenergize the solenoid 113. Accordingly, this embodiment of the receiving apparatus is capable of preventing frequent repetition of energization and deenergization of the solenoid 113 thereby preventing wear of the mechanical section of the coin sorting mechanism and increasing its life.

In case the coil of the receiving solenoid 113 is broken, a coil breakage detection signal S is applied to AND gates 201 and 202 to cause the AND gates 199 and 152 to produce outputs "1", which are applied to a detection operation stoppage control circuit 204 via AND gates 201 and 202 and OR gate 203. Thus, the coil receiving function of the coin receiving apparatus is stopped and the occurrence of the trouble is displayed.

Figure 8:
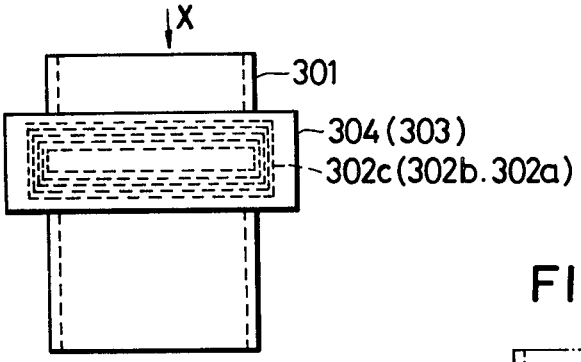
FIG. 8(*a*) is a side view showing an example of an outer diameter detector.
Figure 8:
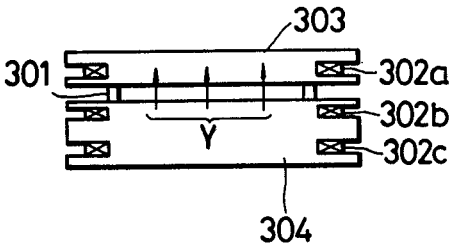

FIGS. 8(*a*) and 8(*b*) show a concrete example of the coin diameter detector employed in the coin receiving apparatus of this invention.

Flat coil 302*a* of a lug type winding is wound on a coil winding member 303 on one side of a coin detecting path 301 such that the winding surface thereof is arranged in parallel with the detection path 301, and flat coils 302*b*, 302*c* of lug type windings are similarly wound on the coil winding member 303 on the other side of the detection path 301 such that the winding surface thereof are arranged in parallel with the path 301.

The coils 302*a*, 302*b*, 302*c* form a differential transformer with the coil 302*b* constituting a primary winding coil and the coils 302*a* and 302*c* secondary winding coils connected in opposite series.

The magnetic field in the coin detection path 301 is produced in the direction as designated by an arrow Y in FIG. 8(*b*) by the coil 302*b* forming the primary coil of the differential transformer.

When the inserted coin falls or passes through the detection path 301 from the direction as designated by an arrow X and reaches the arranged positions of the coils 302*a*, 302*b* and 302*c*, the inserted coin crosses the magnetic field produced by the primary coils 302*b* in such a manner that the diametric surface of the inserted coin is crossing perpendicularly to the magnetic field so that the magnetic flux is crossed in proportion to the area of the diametric surface of the inserted coin.

Accordingly, the secondary coils 302*a* and 302*c* produce a signal corresponding to the area of the diametric surface or the diameter of the inserted coin.

Figure 9:
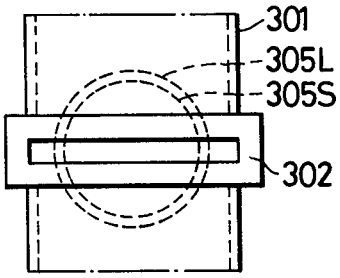
FIGS. 9 and 10 are views for explaining the operation of the outer diameter detector shown in FIGS. 8(*a*) and 8(*b*)

FIG. 9 shows the relationship between the two coins 305S and 305L of different diameters and the coil 302.

The coin detection path 301 is vertically constructed so that the inserted coin may freely drop in the path. Since the magnetic field by the coil 302 is produced perpendicularly relative to the sheet of the drawing there occurs difference in the amount of magnetic flux crossed by the inserted coin between the coin 305S of a smaller diameter and the coin 305L of a larger diameter.

Figure 10:
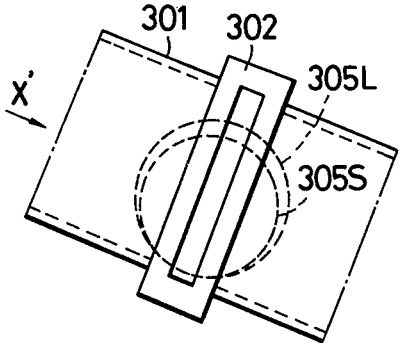

FIG. 10 shows a preferred example of the coin detection path 301 inclined at a predetermined angle wherein the coin inserted from the direction as designated by an arrow X' passes the coil 302 along one side of the path 301. This arrangement also provides a clear difference in the amount of flux crossed by the coin 305S of a smaller diameter and by the coin 305L of a larger diameter.

Accordingly, as obviously seen from the arrangements shown in FIGS. 9 and 10, there occurs difference in the amount of flux crossed by the inserted coin according to the diameter no matter how the coin detection path 301 is constructed, i.e. vertical or oblique, so that the diameter of the inserted coin can be detected on the basis of this difference.

Figure 11:
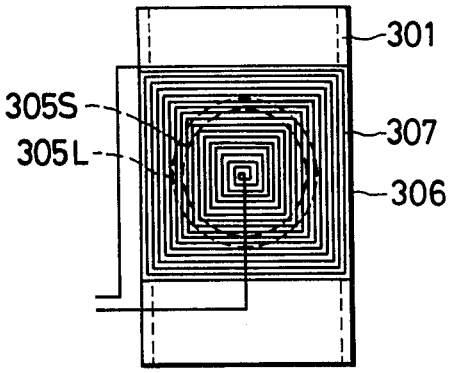
FIG. 11(*a*) is a side view showing another example of an outer diameter detector.
Figure 11:
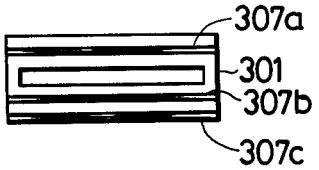

FIGS. 11(*a*) and 11(*b*) show another preferred example of the coin detection path 301 used for the coin receiving apparatus of this invention.

In this example a conductor 307 is spirally deposited on a printed substrate 306 to form winding coils 307*a*, 307*b* and 307*c* thereon. The coils 307*a*, 307*b* and 307*c* are arranged similarly to the arrangement of the coils 302*a*, 302*b* and 302*c*, that is the winding surface of the coils is arranged in parallel with the coin detection path 301 and one coil constitutes primary winding coil and the other two secondary winding coils connected in opposite series, thus forming a differential transformer.

Thus, the arrangement of the coin detection path 301 can be miniaturized and simplified with the conductor deposited on a printed substrate to form coils thereon.

Figure 12:
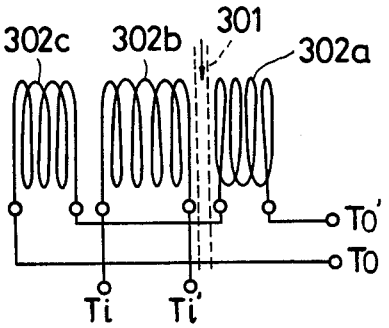

FIG. 12 shows another preferred example of the coin detector of differential transformer type arranged in the coin detection path.

The coil 302*b* forms a primary winding coil connected to a power source of a predetermined frequency between terminals Ti and Ti'. The coils 302*a* and 302*c* form secondary winding coils connected in opposite series.

When the inserted coin drops or passes through the coin detection path 301, a signal is produced between the terminals To and To' in accordance with the diameter of the inserted coin.

It should be appreciated that although the secondary coils of the coin detector are composed of two coils connected in opposite series to each other to form a differential transformer to detect the diameter of the inserted coin based on the output produced from the differential transformer, the secondary coil may also be formed of one coil which produces a signal corresponding to the diameter of the inserted coin.

It is to be noted that a single coil may be arranged in such a manner that its magnetic field with substantially perpendicularly cross the diametric surface of the inserted coin passing through the coin detection path. In this case, difference in diameter between the inserted coins is detected on the basis of variation of slef-inductance of the coil.

What is claimed is:

1. A coin receiving apparatus for a vending machine comprising:

coin detector means for producing an output corresponding to the diameter of an inserted coin, said coin detector means including a coil so arranged that the magnetic flux thereof is substantially perpendicularly crossing the diameter of the inserted coin passing through a coin detection path;

one or more coin detector means of a differential transformer type sequentially arranged adjacent to said coin detector means in the coin detection path for producing an output corresponding to coin characteristic or characteristics other than the coin diameter;

detection control means for controlling said respective coin detector means and judging whether the inserted coin is true or false in response to the detected outputs from said respective coin detector means, said detection control means comprising a supply source for selectively supplying an exciting power of a frequency corresponding to said respective coin detector means, control means for controlling the selective supply of the power from said supply source to said respective coin detector means in a sequential order corresponding to passage of the inserted coin through said respective coin detector means in the coin detection path thereby to cause said respective coin detector means to successively detect the inserted coin, and discriminating means for discriminating a peak level of the detected output of each of said respective coin detector means; and coin receipt control means responsive to the true or false judgement output from said detection control means for controlling the receipt or return of the inserted coin; whereby the inserted coin is received in the coin receiving apparatus if the detected outputs from all of said coin detector means indicate that the inserted coin is true.

2. A coin receiving apparatus as defined in claim 1, wherein said detection control means comprises means responsive to the detected outputs from said respective coin detector means for detecting passage of the inserted coin and producing a detection pulse, sequential control means responsive to the detection pulse from said detecting means for counting the number of the detector means by which the inserted coin has passed and gate means responsive to an output from said sequential control means for controlling the supply of exciting power.

3. A coin receiving apparatus as defined in claim 1, wherein said discriminating means comprises comparator means for presetting an upper limit and lower limit of said peak level of the detected outputs from said respective coin detector means, means for supplying predetermined upper and lower reference values to said comparator means upon receipt of the exciting power selected by said control means and sequentially varying the upper and lower reference values in correspondence to the coin detector means through which the inserted coin is passing, and means for discriminating whether the peak level of the detected output of said respective coin detector means is between the upper and lower limits or not upon receipt of the output from said comparator means and thereupon producing a true or false coin detection output.

4. A coin receiving apparatus as defined in claim 1 further comprising:

means for preventing successive insertion of coins without a proper time interval in said coin receiving apparatus by prohibiting the discriminating operation of said detection control means when a following coin among successively inserted coins is detected by an initial coin detector means in said coin detection path before a preceding coin has passed through all of said coin detector means in said coin detection path and returning the inserted coins;

a timer having at least an operation time corresponding to a period of time required for passage of the inserted coin through all of said coin detector means in said coin detection path and releasing the prohibition of the discriminating operation of said means for preventing successive insertion of coins after the lapse of the operation time; and timer control means for setting said timer upon entering of the inserted coin in said initial coin detector means and setting said timer again and restarting the operation time when a following coin inserted in said coin receiving apparatus is detected by the initial coin detector means before the operation time of the timer lapses.

5. A coin receiving apparatus as defined in claim 1 further comprising:

a timer for resetting the operation of said coin receipt control means when a predetermined operation time has lapsed;

a timer control means for again setting said timer to restart said operation time when the inserted coin has been judged to be true during the operation time of said timer; wherein the operation of said timer is extended to continue the operation of said coin receipt control means when true coins are sequentially inserted in said coin receiving apparatus.

* * * * *